US007837514B2

(12) United States Patent
Fogg

(10) Patent No.: US 7,837,514 B2
(45) Date of Patent: Nov. 23, 2010

(54) ELECTRICAL CONNECTORS WITH VERTICALLY ORIENTED CONTACTS

(75) Inventor: Michael Warren Fogg, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 109 days.

(21) Appl. No.: 12/243,096

(22) Filed: Oct. 1, 2008

(65) Prior Publication Data

US 2010/0081340 A1 Apr. 1, 2010

(51) Int. Cl.
*H01R 13/502* (2006.01)

(52) U.S. Cl. ..... 439/701; 439/717; 439/941

(58) Field of Classification Search ..... 439/699.1, 439/701, 715, 717, 722, 941
See application file for complete search history.

(56) References Cited

U.S. PATENT DOCUMENTS 4,963,098 A * 10/1990 Myer et al. ..... 439/76.1
5,125,854 A * 6/1992 Bassler et al. ..... 439/607.59
5,716,237 A * 2/1998 Conorich et al. ..... 439/660
6,582,244 B2 6/2003 Fogg et al.
6,582,255 B2 6/2003 Simmons et al.
6,669,514 B2 12/2003 Wiebking et al.
6,835,103 B2 * 12/2004 Middlehurst et al. ..... 439/699.1
6,881,100 B2 * 4/2005 Barry et al. ..... 439/701
7,059,919 B2 * 6/2006 Clark et al. ..... 439/825
7,544,104 B2 * 6/2009 Fan et al. ..... 439/722
7,572,156 B2 * 8/2009 Schroll et al. ..... 439/717
7,597,573 B2 * 10/2009 Defibaugh et al. ..... 439/206
2007/0293084 A1 * 12/2007 Ngo ..... 439/552
2008/0207029 A1 * 8/2008 Defibaugh et al. ..... 439/206
2010/0081340 A1 * 4/2010 Fogg ..... 439/701

* cited by examiner

*Primary Examiner*—James Harvey

(57) ABSTRACT

An electrical connector assembly includes a plug connector and a receptacle connector. The plug connector has plug contacts and a shroud partially surrounding the plug contacts. The shroud has a shape that is elongated along a longitudinal axis. The stood frames the plug contacts. The receptacle connector has a nose with a shape that is elongated along the longitudinal axis. The nose includes a plurality of slots formed therein and oriented along a transverse axis relative to the longitudinal axis. The plug contacts are separated from the shroud such that when the plug and receptacle connectors are co-nested with one another, the nose is received in the shroud and the plug contacts are received in a corresponding one of the slots in order to mate the plug and receptacle connectors.

19 Claims, 8 Drawing Sheets

ELECTRICAL CONNECTORS WITH VERTICALLY ORIENTED CONTACTS

BACKGROUND OF THE INVENTION

The subject matter herein relates generally to electrical connectors, and more particularly, to high density electrical connectors.

A variety of electrical connectors are used for electrical connections in a variety of computer, telecommunication and other applications. For example, some known CHAMP® connectors are used in computing and telecommunicating applications. These connectors include a plug connector that mates with a receptacle connector. The plug and receptacle connectors are elongated along a horizontal direction. Each of the plug and receptacle connectors includes a plurality of electrical contacts. The contacts are oriented in a single pair of parallel rows. The parallel rows of contacts in the plug connector engage the parallel rows of contacts in the receptacle connector when the plug connector and receptacle connectors mate with one another.

The contacts in each row are separated from one another by a minimum distance. For example, the rows of contacts may be separated by at least 4.32 millimeters. This minimum distance is established to reduce the effects of crosstalk on adjacent contacts. As the distance between the rows of contacts is decreased, the signals communicated using the contacts may degrade due to crosstalk.

With increasing bandwidth and signal speeds, additional contacts in electrical connectors may be necessary. However, the space available for the addition of more contacts, is limited. Thus, in order to increase the number of contacts, more contacts may need to be placed closer together. As more contacts are added to a limited space on a circuit board, adjacent contacts or adjacent rows of contacts may be positioned too close to one another. As described above, placing the contacts or rows of contacts too close to one another can cause signal degradation.

Thus, a need exists to reduce the amount of space that a connector occupies on a circuit board, while still providing sufficient distance between the contacts in the connector to reduce crosstalk between the contacts.

BRIEF DESCRIPTION OF THE INVENTION

In one embodiment, an electrical connector assembly includes a plug connector and a receptacle connector. The plug connector has plug contacts and a shroud partially surrounding the plug contacts. The shroud has a shape that is elongated along a longitudinal axis. The shroud frames the plug contacts. The receptacle connector has a nose with a shape that is elongated along the longitudinal axis. The nose Includes a plurality of slots formed therein and oriented along a transverse axis relative to the longitudinal axis. The plug contacts are separated from the shroud such that when the plug and receptacle connectors are co-nested with one another, the nose is received in the shroud and the plug contacts are received in a corresponding one of the slots in order to mate the plug and receptacle connectors.

In another embodiment, an electrical plug connector is provided. The plug connector is configured to mate with an electrical receptacle connector to provide an electrical connection between the plug and receptacle connectors. The receptacle connector has a nose with a shape that is elongated along a longitudinal axis and a plurality of slots in the nose with a plurality of receptacle contacts disposed along opposing sides of each of the slots. The plug connector includes a housing, a plurality of chicklets and a plurality of plug contacts. The housing has a shroud that is configured to receive the nose of the receptacle connector. The shroud has a shape that is elongated along the longitudinal axis. The chicklets are held by the housing. Each chicklet has a contact portion protruding from a header portion. The contact portion is located proximate to the shroud and is oriented along a transverse axis. The transverse axis is transverse to the longitudinal axis. The plug contacts are arranged in groups, with each of the groups being held by a corresponding one of the chicklets. The plug contacts in each of the groups are arranged in parallel rows along the contact portion. The shroud receives the nose and each of the slots receives one of the contact portions when the plug and receptacle connectors mate with one another so that the plug and receptacle contacts engage one another.

In another embodiment, an electrical receptacle connector is provided. The receptacle connector is configured to mate with an electrical plug connector to provide an electrical connection between the plug and receptacle connectors. The plug connector has a shroud with a shape that is elongated along a longitudinal axis and a plurality of contact walls elongated along a transverse axis. The transverse axis is transverse to the longitudinal axis. Each of the contact walls holds a group of plug contacts aligned along the transverse axis. The receptacle connector includes a housing, a plurality of chicklets and a plurality of receptacle contacts. The housing has a nose that is configured to be inserted into the shroud of the plug connector. The nose has a shape that is elongated along the longitudinal axis. The chicklets are held by the housing. Each chicklet has a receptacle wall protruding from a header portion. The receptacle walls are located proximate to the nose and oriented along the transverse axis. The receptacle contacts are arranged in groups, with each of the groups being held by a corresponding one of the chicklets. The receptacle contacts in each of the groups are arranged in parallel rows along the receptacle wall. The nose is inserted into the shroud and each of the contact walls is inserted between adjacent ones of the receptacle walls when the plug and receptacle connectors mate with one another so that the plug and receptacle contacts engage one another.

DETAILED DESCRIPTION OF THE INVENTION

Figure 1:
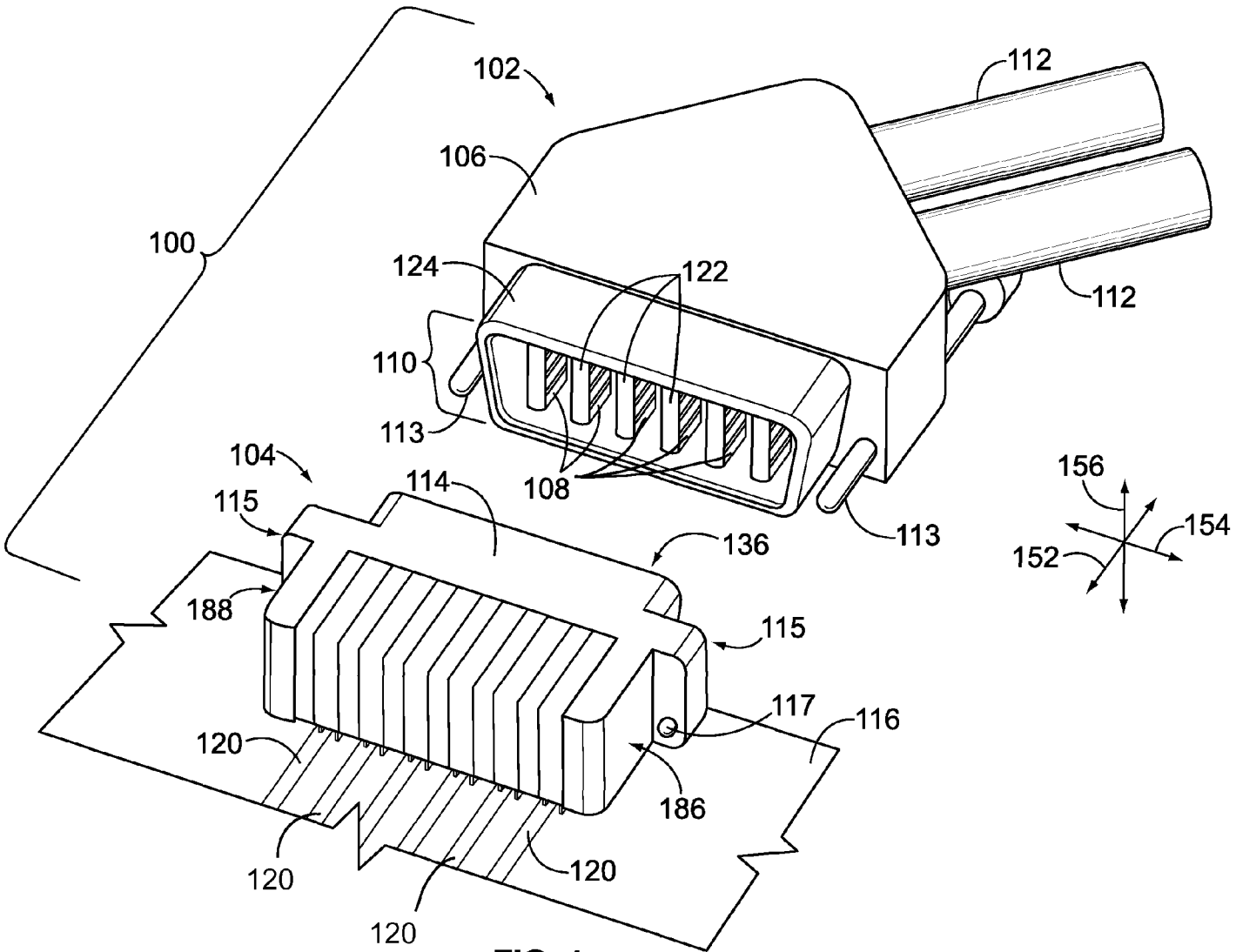
FIG. 1 is a perspective view of an exemplary embodiment of a connector assembly including a receptacle connector and a plug connector.

FIG. 1 is a perspective view of an exemplary embodiment of a connector assembly 100 including a plug connector 102 and a receptacle connector 104. The connector assembly 100 includes a plug connector 102 and a receptacle connector 104. The plug connector 102 mates with the receptacle connector 104 to establish an electrical connection between the plug connector 102 and the receptacle connector 104.

The plug connector 102 includes a plug housing 106. The plug housing 106 may include or be formed from a dielectric material, such as a plastic material. Alternatively, the plug housing 106 includes or is formed from a conductive material, such as a metal material. The plug housing 106 is connected to one or more cables 112. In some embodiments, each of the cables 112 may be a shielded cable that includes a plurality of twisted pair wires (not shown) extending along the inside of the cable 112. The cable 112 is mechanically connected to the plug housing 106. The cables 112 also may terminate to an external device (not shown). For example, the cables 112 may be electrically connected to a telecommunications device.

The plug housing 106 has a shroud 124 that protrudes from the plug housing 106 along a mating direction 152. The mating direction 152 is the direction in which the plug connector 102 and receptacle connector 104 move relative to one another in order to mate the plug and receptacle connectors 102, 104. The shroud 124 has a shape that is elongated along a longitudinal axis 154. In some embodiments, the longitudinal axis 154 is parallel to the horizontal direction. The mating direction 152 and longitudinal axis 154 may be perpendicular to one another. The shroud 124 receives a nose 136 of the receptacle connector 104 during mating of die plug and receptacle connectors 102, 104.

The shroud 124 frames a plug interface profile 110. The orientation of a plurality of plug contacts 108 in the shroud 124 also defines the plug interface profile 110. The shroud 124 partially surrounds the plug contacts 108. For example, the shroud 124 may extend around the periphery of the plug interface profile 110 and the plug contacts 108. The plug Interface profile 110 is elongated along the longitudinal axis 154. A plurality of chicklets 122 is located proximate to the shroud 124. The chicklets 122 each support a plurality of the plug contacts 108 in a position that is proximate to the shroud 124. In the illustrated embodiment, the plug contacts 108 are provided in a plurality of groups. Each group of plug contacts 108 includes a pair of parallel rows of plug contacts 108. In an exemplary embodiment, each chicklet 122 supports one group of the plug contacts 108. The pairs of rows of plug contacts 108 are oriented in the plug interface profile 110 along a transverse axis 156. In some embodiments, the transverse axis 156 is parallel to the vertical direction. In the illustrated embodiment, the transverse axis 156 is perpendicular to the longitudinal axis 154 and to the mating direction 152.

The plug contacts 108 are electrical contacts that are electrically connected to wires (not shown) inside the cables 112. For example, the wires inside the cables 112 may be soldered to the plug contacts 108 inside the plug housing 106. In another example, the wires inside the cables 112 are terminated to the plug contacts 108 using an Insulation Displacement Connection ("IDC"). Other methods and manners of terminating the wires inside the cables 112 to the plug contacts 108 are possible in alternative embodiments.

One or more alignment pins 113 protrude from the plug housing 106 in a location that is proximate to the shroud 124. In the illustrated embodiment, two alignment pins 113 are provided. The alignment pins 113 are inserted into receiving holes 117 in the receptacle connector 104 to align the plug and receptacle connectors 102, 104 when mated with one another. In some embodiments, the alignment pins 113 and receiving holes 117 each include threaded connections to secure the plug and receptacle connectors 102, 104 with one another. For example, the alignment pins 113 may each include a male threaded connection (not shown) and the receiving holes 117 may each include a female threaded connection.

The receptacle Connector 104 includes a receptacle housing 114. The receptacle housing 114 is mounted on a circuit board 116. In some embodiments, the receptacle housing 114 includes, or is formed from, a dielectric material, such as a plastic material. In one or more other embodiments, the receptacle housing 114 includes, or is formed from, a conductive material, such as a metal material. One or more flanges 115 may project from opposing sides 186, 188 of the receptacle housing 114. Two flanges 113 extend in opposing directions along the longitudinal axis 154 from the receptacle housing 114 in the illustrated embodiment. Each of the flanges 115 may include the receiving hole 117 that receives the alignment pin 113 when the plug and receptacle connectors 102, 104 mate with one another.

The receptacle housing 114 includes the nose 136. The nose 136 is inserted into the shroud 124 of the plug housing 106 during mating of the plug and receptacle connectors 102, 104. The receptacle connector 104 also includes a plurality of receptacle contacts 134 (shown in FIG. 2). The receptacle contacts 134 electrically connect with the plug contacts 108 when the plug connector 102 mates with the receptacle connector 104.

The receptacle contacts 134 also are electrically connected with one or more conductive traces 120 of the circuit board 116. The conductive traces 120 may electrically connect the receptacle contacts 134 with a device (not shown) or another component. The device may house the circuit board 116 and the receptacle connector 104. Additionally, the device may include an opening (not shown) through which the nose 136 is accessible from the outside of the device. For example, the nose 136 may protrude from the device through the opening so that the shroud 124 of the plug connector 102 may receive the nose 136 from the outside of the device.

The receptacle connector 104 closes a circuit that includes the cable 112, the plug contacts 108, the receptacle contacts 134, and the conductive traces 120 when the plug connector 102 mates with the receptacle connector 104. The cable 112 may then communicate electrical signals between the external device to which the cable is connected 112 and the circuit board 116.

Figure 2:
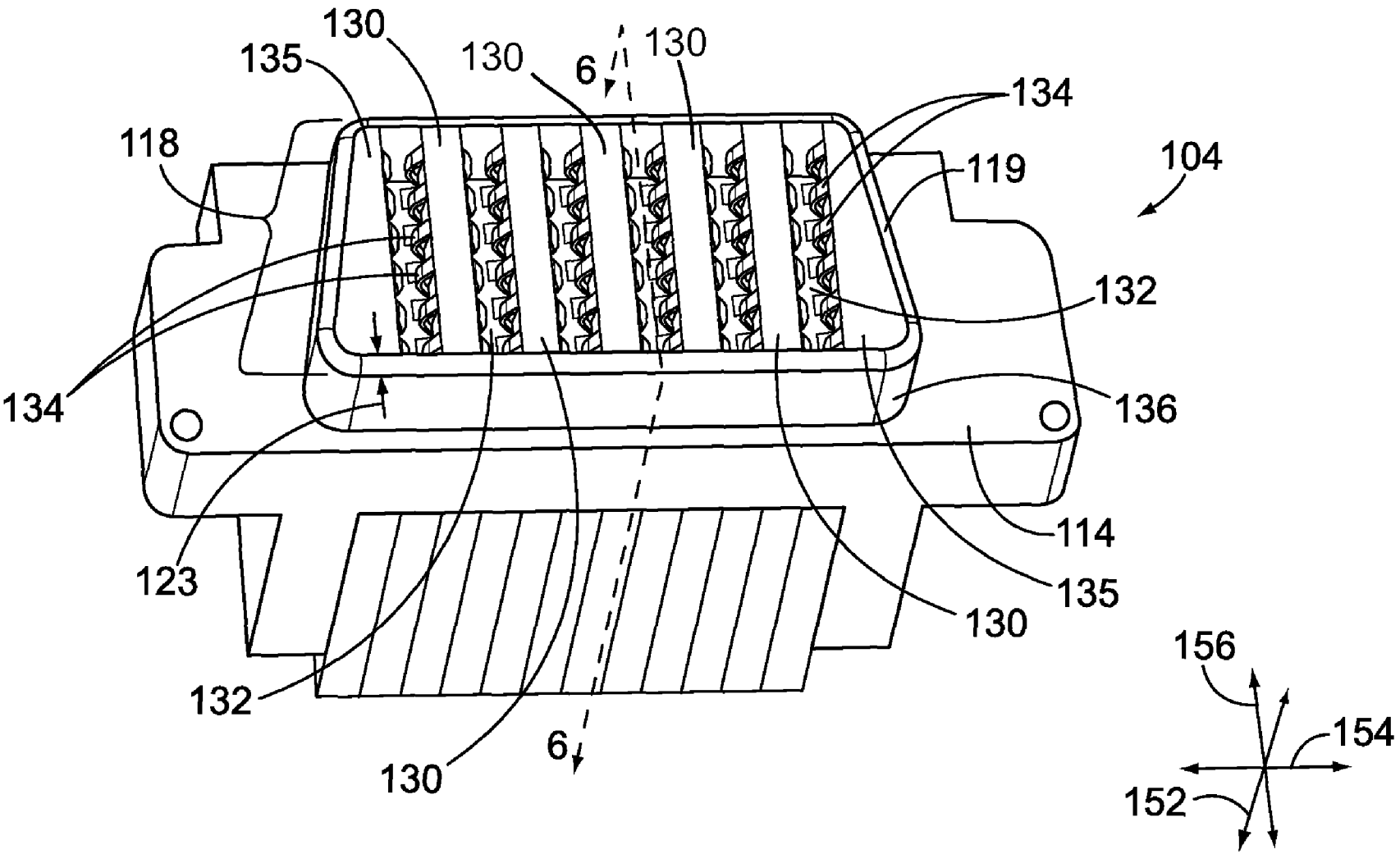
FIG. 2 is a perspective view of the receptacle connector shown in FIG. 1.

FIG. 2 is a perspective view of the receptacle connector 104. The plug and receptacle connectors 102, 104 mate with one another by inserting each of the chicklets 122 in the plug connector 102 into one of a plurality of slots 132 in the receptacle connector 104. In some embodiments, the nose 136 also is inserted into the shroud 124 (shown in FIG. 1) of the plug connector 124.

The nose 136 is elongated along the longitudinal axis 154. The nose 136 has an outer lip 119 that extends around the periphery of the nose 136 and that protrudes along the mating direction 152. The outer lip 119 has a thickness 123 along the periphery of the nose 136. The thickness 123 may be approximately the same throughout the periphery of the nose 136. The nose 136 frames a receptacle interface profile 118. The orientation of a plurality of receptacle contacts 134 in the nose 136 also defines the receptacle Interface profile 118.

The receptacle Interlace profile 118 is elongated along the longitudinal axis 154. A plurality of receptacle walls 130 and a pair of outer walls 135 are provided in the nose 136 at the receptacle interface profile 118. The receptacle walls 130 are elongated along the transverse axis 156. Each of the slots 132 is located between adjacent receptacle walls 130. The slots 132 also are elongated along the transverse axis 156. Each of the receptacle walls 130 supports a row of receptacle contacts 134. In the illustrated embodiment, a pair of parallel rows of receptacle contacts 134 is provided in each slot 132, with a single row of receptacle contacts 134 being mounted on adjacent receptacle walls 130 of each slot 132.

The receptacle wails 130 are spaced apart from one another in the receptacle interface profile 118 so that each of the chicklets 122 (shown in FIG. 1) of the plug connector 102 (shown in FIG. 1) fits into a slot 132. The plug contacts 108 (shown in FIG. 1) mounted on the chicklets 122 contact the receptacle contacts 134. For example, the plug contacts 108 on opposing sides of a chicklet 122 electrically contact the receptacle contacts 134 located on opposing sides of the slot 132 into which the chicklet 122 is inserted. In some embodiments, each of the chicklets 122 is held in a slot 132 through a press fit connection between the plug contacts 108 and the receptacle contacts 134, and/or between the chicklet 122 and the receptacle walls 130 on both sides of the slot 132.

In one or more other embodiments, the plug and receptacle connectors 102, 104 co-nest with one another. The nose 136 of the receptacle connector 104 nests within the shroud 124 of the plug connector 102 and the chicklets 122 of the plug connector 102 nest within the slots 132 of the receptacle connector 104. For example, the shroud 124 of the plug connector 102 and the nose 136 of the receptacle connector 104 may have complementary shapes so that the nose 136 may be received in the shroud 124 when the plug and receptacle connectors 102, 104 mate with one another. The slots 132 in the receptacle connector 104 and the chicklets 122 in the plug connector 102 may have complementary shapes so that the chicklets 122 are received in the slots 132 when the plug and receptacle connectors 102, 104 mate with one another.

Figure 3:
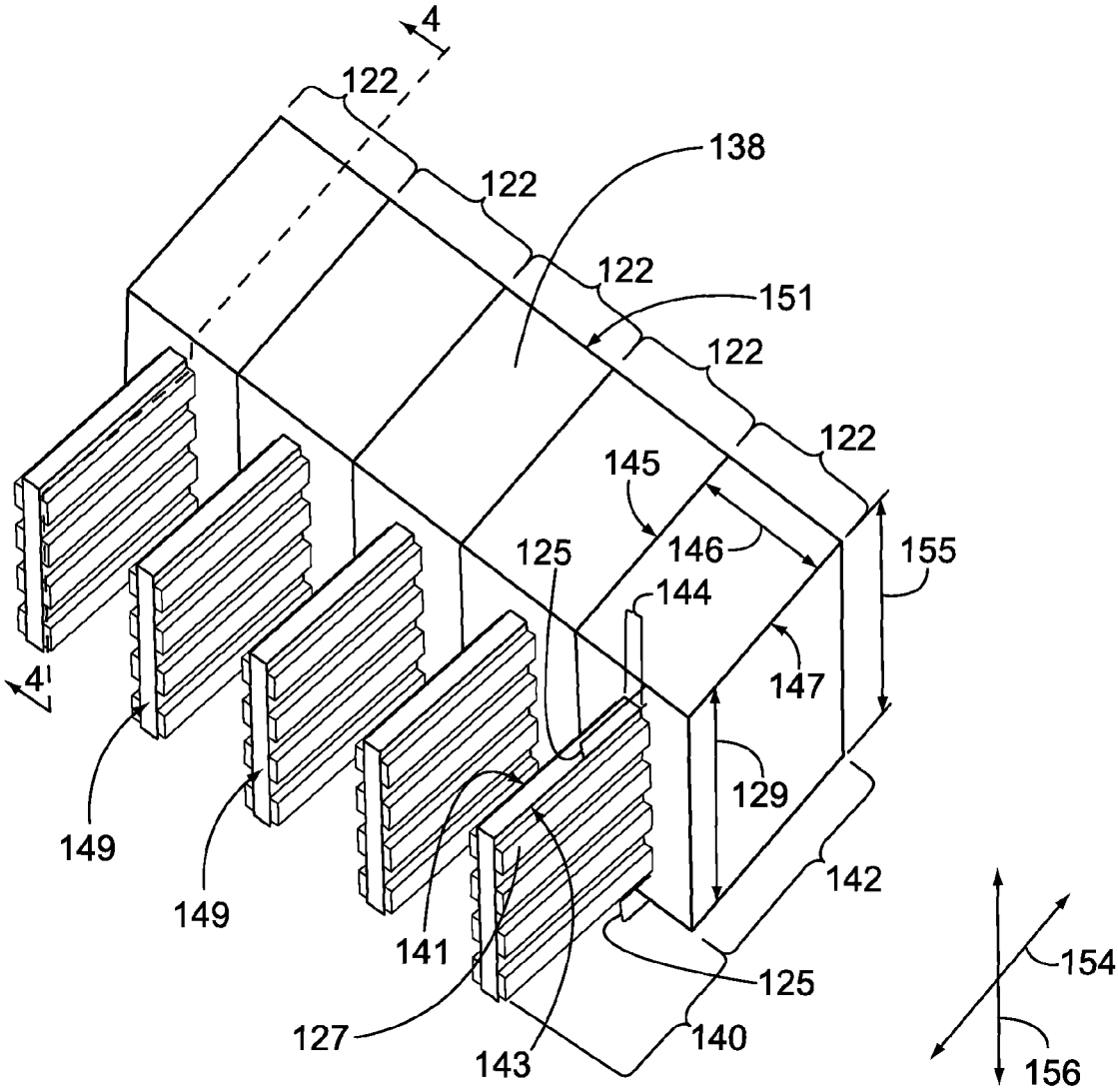
FIG. 3 is a perspective view of exemplary chicklets for use with the plug connector shown in FIG. 1.

FIG. 3 is a perspective view of exemplary chicklets 122 for use with the plug connector 102. The chicklets 122 may be arranged directly adjacent to one another, as shown in the illustrated embodiment. For example, the chicklets 122 may be stacked next to one another inside the plug housing 106.

Each of the chicklets 122 includes a dielectric body 138. The body 138 includes or is formed from a dielectric material. The dielectric body 138 includes a contact wall 140 that protrudes from a header portion 142. The contact wall 140 is integrally formed with the header portion 142 in some embodiments. The header portion 142 may be partially enclosed by the plug housing 106 (shown in FIG. 1). The header portion 142 of each chicklet 122 directly contacts or abuts the header portion 142 of at least one other chicklet 122 in some embodiments. The header portion 142 and contact wall 140 each extend along the transverse axis 156 by a height 155. The contact wall 140 extends away from the header portion 142 along the longitudinal axis 154. The contact wall 140 is at least partially Inserted into a slot 132 (shown, in FIG. 2) in the receptacle connector 104 (shown in FIG. 2) when the plug and receptacle connectors 102, 104 mate with one another.

A thickness 144 of the contact wall 140 is less than a thickness 146 of the header portion 142. For example, the thickness 144 between opposing contact sides 141, 143 of the contact wall 140 is less than the thickness 146 between opposing sides 145, 147 of the header portion 142.

The contact wall 140 has a height 127 that is less than a height 129 of the header portion 142. The difference between the height 127 of the contact wall 127 and the height 129 of the header portion 142 may provide a clearance distance 125 above and/or below each contact wall 140. For example, approximately one half of the difference between the heights 127, 129 of the contact and header portions 140, 142 may be provided as a clearance distance 125 both above and below each contact wall 140. The clearance distance 125 may be large enough to receive the nose 136 (shown in FIG. 2) of the receptacle connector 104 (shown in FIG. 2) when the nose 136 is received in the shroud 124 (shown, in FIG. 1) of the plug connector 102 (shown in FIG. 1). For example, the thickness 123 (shown in FIG. 2) of the nose 136 may be approximately the same as the clearance distance 125 so that the nose 136 may be received in the shroud 124. In another example, the thickness 123 of the nose 136 may be less than the clearance distance 125.

Each of the contact sides 141, 143 holds a plurality of plug contacts 108. The plug contacts 108 may be secured to the contact sides 141, 143, such as being deposited into recesses or slots (not shown) extending along the contact sides 141, 143. In some embodiments, the plug contacts 108 may be secured to the contact sides 141, 143 using an adhesive. The plug contacts 108 may extend between a mating end 149 and a back end 151 of each chicklet 122. The mating end 149 is Inserted into a slot 132 (shown in FIG. 2) of the receptacle connector 104 (shown in FIG. 2) when the plug and receptacle connectors 102, 104 mate with one another.

Figure 4:
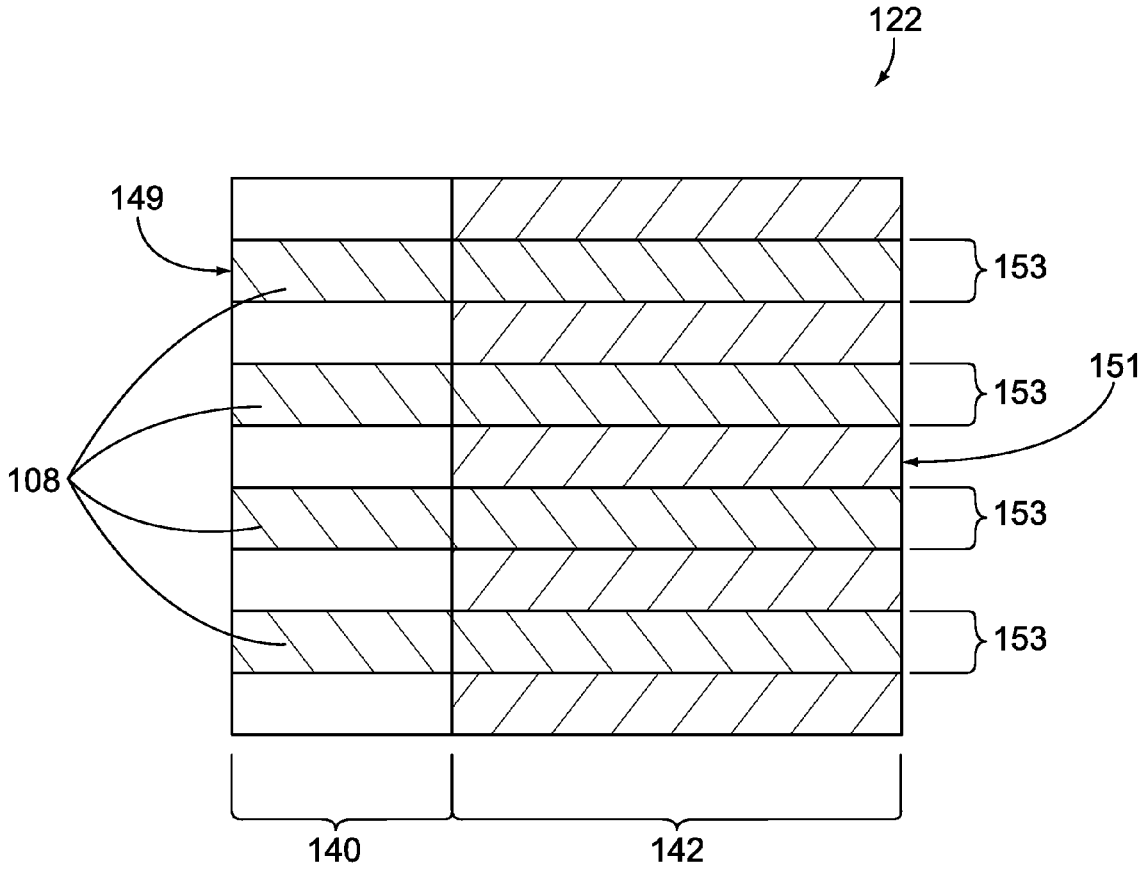
FIG. 4 is a partial cross-sectional view of the chicklets shown in FIG. 3 taken along the line 4-4 also shown in FIG. 3.

FIG. 4 is a partial cross-sectional view of the chicklets 122 shown in FIG. 3 taken along the line 4-4 also shown in FIG. 3. As shown in FIG. 4, the plug contacts 108 may extend from the mating end 149 to the back end 151 along the outside of the contact wall 140 of the chicklet 122 and along the inside of the header portion 142. For example, on the contact end 140, the plug contacts 108 are located on the outside of the chicklet 122. The plug contacts 108 pass through the Inside of the header portion 142 to the back end 151. A portion 153 of the plug contacts 108 may be exposed at the back end 151. One or more wires or other contacts (not shown) of the cable 112 may be terminated to each of the exposed parts of the plug contacts 108 at the back end 151. For example, the wires of the cable 112 may be soldered to the exposed parts of the plug contacts 108 at the back end 151. Optionally, the plug contacts 108 may define solder pads (not shown) at the back end 151 to facilitate a soldered connection with the wire. The plug contacts 108 may then permit electric communication from the cable 112 between the back and mating ends 151, 149 of the chicklet 122.

Figure 5:
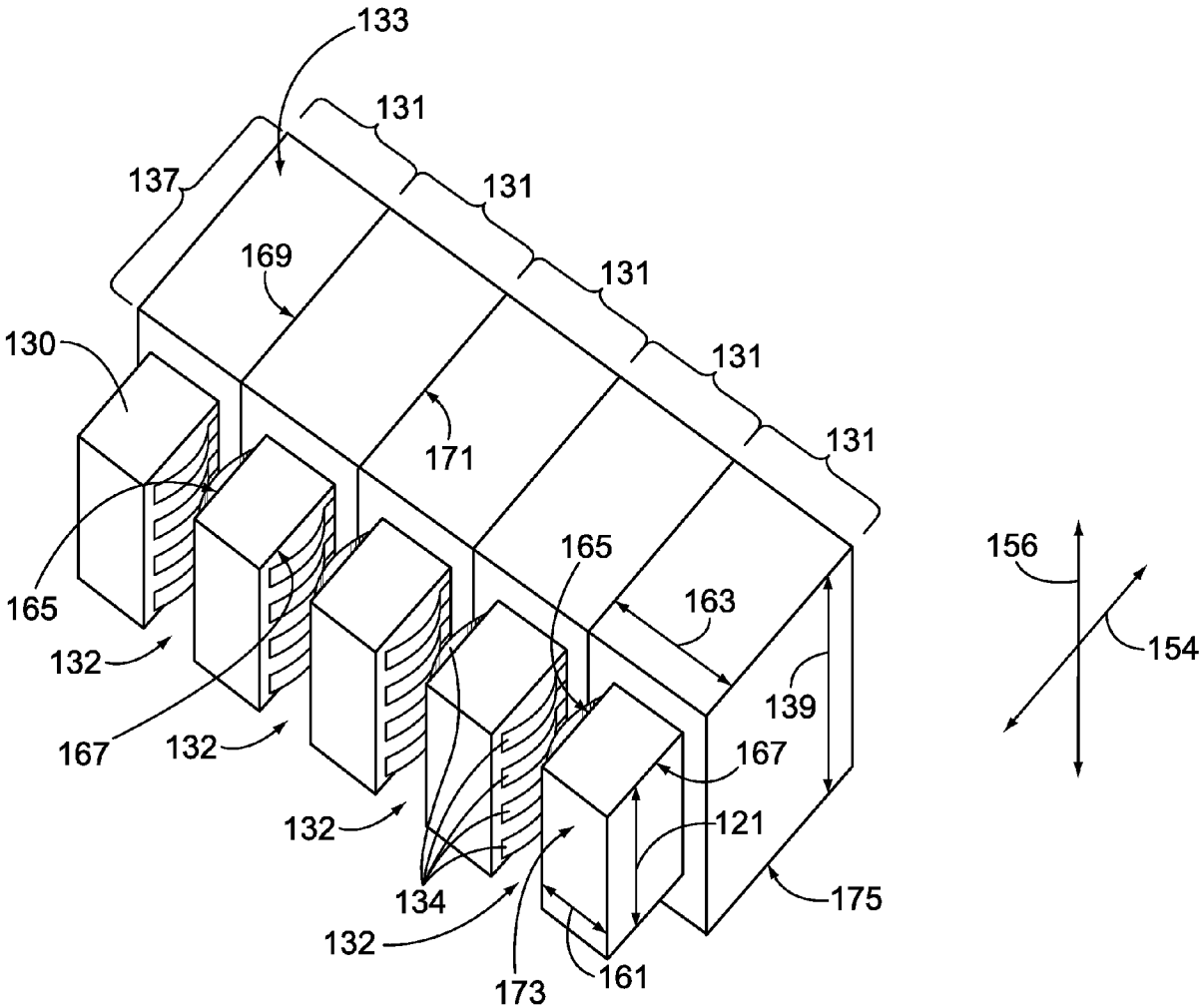
FIG. 5 is a perspective view of receptacle chicklets for use with the receptacle connector shown in FIG. 2.

FIG. 5 is a perspective view of receptacle chicklets 131 for use with the receptacle connector 104 shown in FIG. 2. In some embodiments, the receptacle connector 104 includes a plurality of receptacle chicklets 131 in a manner similar to the chicklets 122 of the plug connector 102. For example, the receptacle connector 104 may Include a plurality of the receptacle chicklets 131 that are arranged directly adjacent to one another, as shown in the illustrated embodiment. For example, the receptacle chicklets 131 maybe stacked next to one another.

Each of the receptacle chicklets 131 includes a dielectric body 133. The body 133 includes or is formed from a dielectric material. The dielectric body 133 includes the receptacle wall 130 protruding from a header portion 137. The header portion 137 of each receptacle chicklet 131 directly contacts or abuts the header portion 137 of at least one other receptacle chicklet 131 in some embodiments. The header portion 137 extends along the transverse axis 156 by a height 139. The receptacle walls 130 extend along the transverse axis 156 by a height 121. The receptacle wall 130 extends away from the header portion 137 along the longitudinal axis 154.

A thickness 161 of each of the receptacle walls 130 is less than a thickness 163 of the header portion 137. For example, the thickness 161 between opposing sides 165, 167 of the receptacle wall 130 is less than the thickness 163 between opposing sides 169, 171 of the header portion 137.

Each of the sides 165, 167 holds a plurality of the receptacle contacts 134. In the illustrated embodiment, the receptacle contacts 134 bow outward away from the sides 165, 167. In other embodiments, the receptacle contacts 134 may be substantially flat against the sides 165, 167. The receptacle contacts 134 may extend between a front end 173 and a base end 175 of each receptacle chicklet 131. The front and base ends 173, 175 may be perpendicular to one another.

The slots 132 are disposed between the receptacle walls 130 of adjacent receptacle chicklets 131. In some embodiments, the contact wall 140 (shown in FIG. 3) of the chicklets 122 in the plug connector 102 (shown in FIG. 1) are inserted into the slots 132 when the plug and receptacle connectors 102, 104 (shown in FIG. 1) mate. The plug contacts 108 (shown in FIG. 3) on the contact walls 140 of the chicklets 122 engage the receptacle contacts 134 on the adjacent receptacle walls 130 to provide an electrical connection between the plug and receptacle contacts 108, 134.

Figure 6:
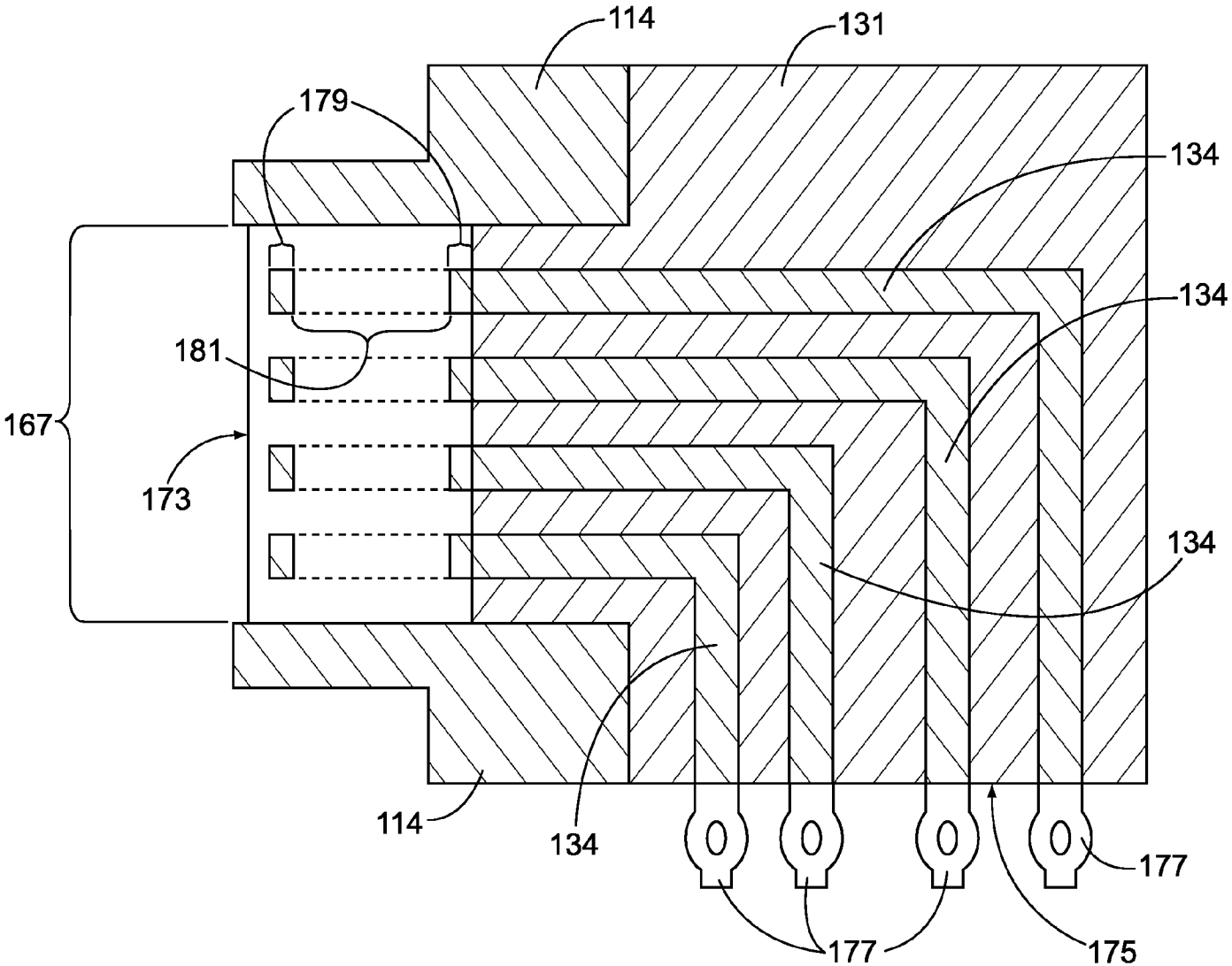
FIG. 6 is a partial cross-sectional view of the receptacle housing and the receptacle chicklets taken along the line 6-6 shown in FIG. 2.

FIG. 6 is a partial cross-sectional view of the receptacle housing 114 and the receptacle chicklets 131 taken along the line 6-6 shown in FIG. 2. As shown in FIG. 6, the receptacle contacts 134 may extend between the front and base ends 173, 175 of the receptacle chicklets 131 in one exemplary embodiment. For example, the receptacle contacts 134 may bend Inside the receptacle chicklet 131 at an angle of approximately 90 degrees. In another embodiment, the front and base ends 173, 175 are parallel to one another.

The receptacle contacts 134 may terminate at one or more pins 177. In the illustrated embodiment, the pins 177 are integrally formed with the receptacle contacts 134. Alternatively, the pins 177 may be coupled to the receptacle contacts 134 using a solder or other conductive connection. The pins 177 may be located in a location that is proximate to the base end 175 of the receptacle chicklets 131. The base end 175 of each receptacle chicklet 131 is mounted onto the circuit board 116 (shown in FIG. 1) in some embodiments. The pins 177 may be inserted into corresponding holes or apertures (not shown) in the circuit board 116 when the base end 175 is mounted onto the circuit board 116. The pins 177 may be electrically connected to one or more of the conductive traces 120 (shown in FIG. 1) once the pins 177 are inserted into the circuit hoard 116.

In the illustrated embodiment, the receptacle contacts 134 contact the receptacle chicklet 131 at a plurality of contact areas 179 on the side 167 and bow away from the side 167 over an arcuate portion 181 of each receptacle contact 134. In another embodiment each, of the receptacle contacts 134 is substantially flat against the side 167. While the relationship of the receptacle contacts 134 and the side 167 is shown in FIG. 6, the relationship of the receptacle contacts 134 and the side 165 (shown in FIG. 5) is similar.

Figure 7:
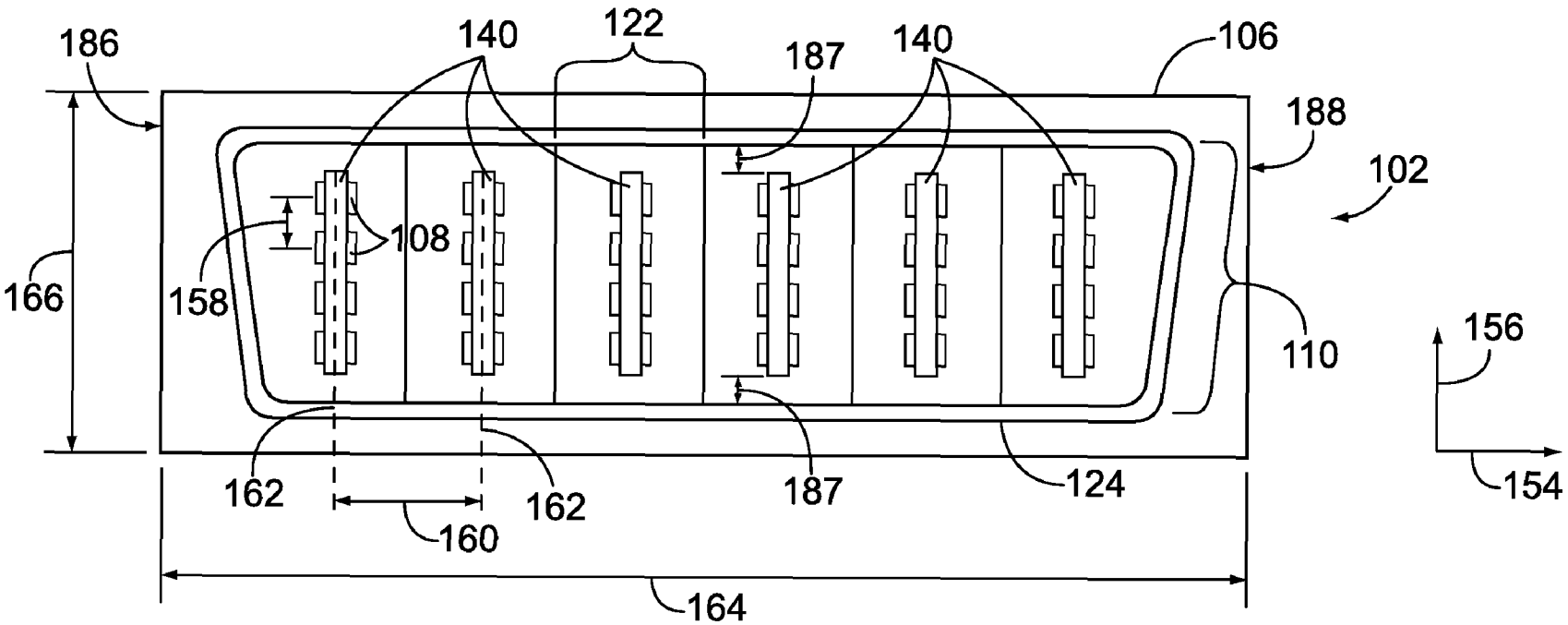
FIG. 7 is an elevational view of the plug connector shown in FIG. 1 illustrating an exemplary plug interface profile.

FIG. 7 is an elevational view of the plug connector 102 illustrating an exemplary plug interface profile 110. The plug connector 102 includes six chicklets 122, with each chicklet 122 having four pairs of plug contacts 108 mounted on the contact wall 140 of the chicklet 122. Thus, the plug connector 102 includes a total of 48 plug contacts 108.

The plug housing 106 has an exterior width 164 along the longitudinal axis 154 between opposing exterior sides 186, 188 and a height 166 along the transverse axis 156. In some embodiments, the width 164 is less than a width of known RJ-21 connectors having the same number of contacts as the plug connector 102. In another embodiment the width 164 is less than a width of known RJ-45 connectors having the same number of contacts as the plug connector 102. For example, the width 164 may be 45 millimeters or less. The width 164 may be less than the width of known RJ-21 and RJ-45 connectors while still including 48 plug contacts 108 due to the vertical orientation of the chicklets 122. The chicklets 122 may be placed closer together by vertically aligning the chicklets 122 in the plug connector 102 than would otherwise be possible if the chicklets 122 and/or plug contacts 108 were aligned along the longitudinal axis 154.

The contact walls 140 of adjacent chicklets 122 may be separated by a separation distance 160. For example, a center line 162 running through the center of the contact wall 140 of each chicklet 122 may be separated from the center lines 162 of adjacent chicklets 122 by the separation distance 160. In some embodiments, the separation distance 160 is large enough to eliminate crosstalk between the plug contacts 108 on adjacent chicklets 122. For example, the separation distance 160 may be large enough to avoid one signal communicated using a plug contact 108 on one chicklet 122 from disturbing or affecting another signal that is communicated using another plug contact 108 on an adjacent chicklet 122. By way of example only, the separation distance 160 may be at least 5 millimeters. A different separation distance 160 may be used in other embodiments. For example, the separation distance 160 may be 4.32 millimeters or more.

The contact walls 140 are separated from the shroud 124 along the transverse axis 156 by a clearance distance 187. The clearance distance 187 may be at least as great as the thickness 123 (shown in FIG. 2) of the outer lip 119 (shown in FIG. 2) of the nose 136 (shown in FIG. 2) of the receptacle connector 104 (shown in FIG. 2) so that the outer lip 119 can be received in the plug connector 102 between the contact walls 140 and the shroud 124.

In some embodiments, the plug contacts 108 on the contact chicklets 122 are separated by a contact spacing 158. For example, the distance between the centers of two adjacent plug contacts 108 may be the contact spacing 158. The contact spacing 158 may be approximately the same as the spacing between contacts in known RJ-21 or RJ-45 connectors. For example, the contact spacing 158 may be approximately 2.159 millimeters, or 0.0850 inches. This contact spacing 158 may permit the plug contacts 108 to withstand testing conditions for telecom electrical connectors. For example, the contact spacing 158 that is approximately the same as the contact spacing for RJ-21 or RJ-45 connectors may permit the plug connector 102 to withstand the testing standard of GR-1089, which simulates a lightning strike and a voltage surge. Other contact spacings 158 may be used in other embodiments.

Figure 8:
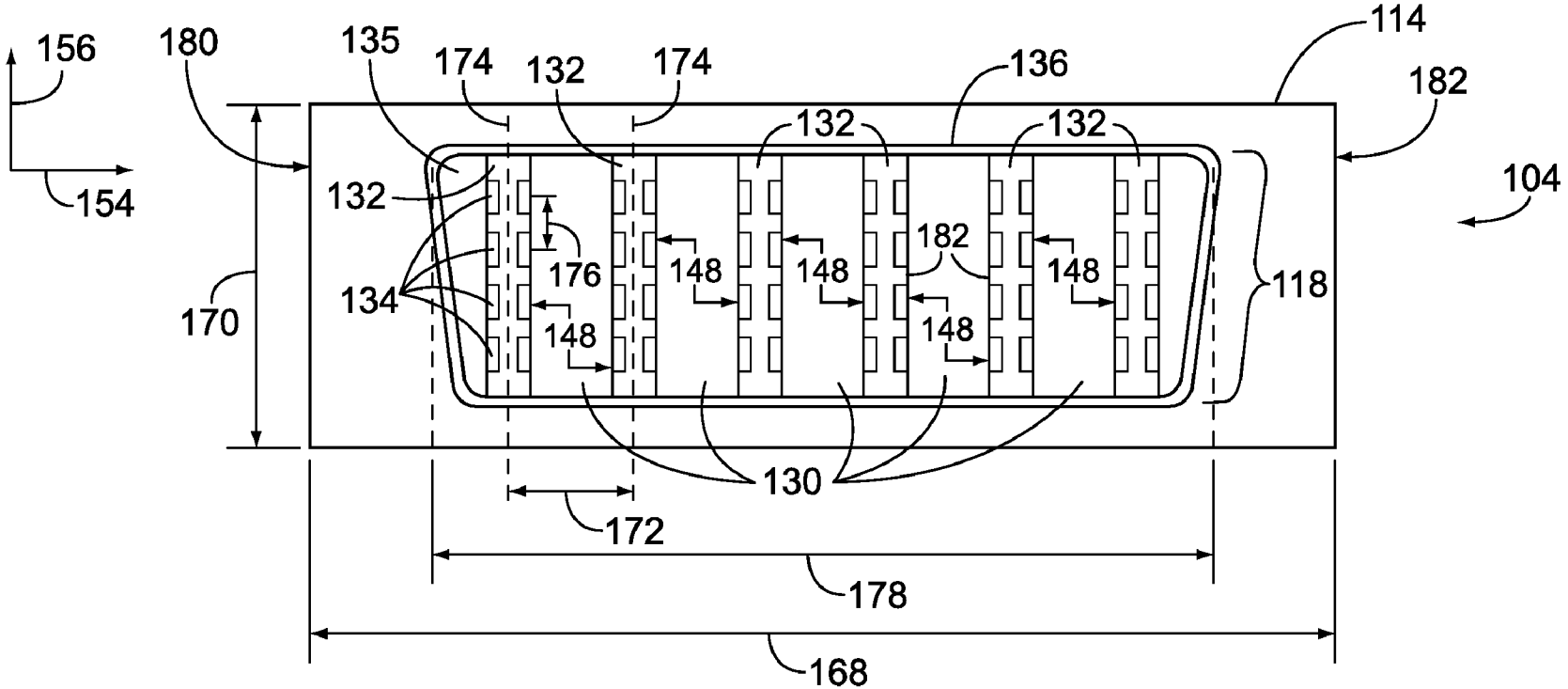
FIG. 8 is an elevational view of the receptacle connector shown in FIG. 2 illustrating an exemplary receptacle interface profile.

FIG. 8 is an elevational view of the receptacle connector 104 shown in FIG. 2 illustrating an exemplary receptacle interface profile 118. The receptacle connector 104 includes live receptacle walls 130 located between the outer walls 135. Each of the receptacle walls 130 are bounded by a pair of substantially parallel wall surface 148 and each of the outer walls 135 is bounded by a single wall surface 148 and the outer lip 119 (shown in FIG. 2). The receptacle walls 130 separate six slots 132 from one another. Each of the slots 132 receives one of the chicklets 122 when the plug connector 102 mates with the receptacle connector 104. Each of the slots 132 includes eight receptacle contacts 134, with four receptacle contacts 134 being mounted on each of the wall surfaces 148. Thus, the receptacle connector 104 includes 48 receptacle contacts 134. The receptacle contacts 134 engage the plug contacts 108 when the chicklets 122 mate with the slots 132.

The slots 132 may be separated by a separation distance 172. For example, a center line 174 of each slot 132 may be separated from the center lines 174 of adjacent slots 132 by the separation distance 172. In some embodiments, the separation distance 172 of the slots 132 is approximately the same as the separation distance 160 of the chicklets 122. A different separation distance 172 may be used in other embodiments. For example, the separation distance 172 may slightly differ from the separation distance 160 of the chicklets 122.

The receptacle contacts 134 are separated by the contact spacing 176. For example, the distance between the centers of two adjacent receptacle contacts 134 may be the contact spacing 176. The contact spacing 176 may be approximately the same as the contact spacing 158 of the plug contacts 108 in the plug connector 102. In some embodiments, the contact spacing 176 is approximately the same as the spacing between contacts in receptacles for known RJ-21 or RJ-45 connectors. For example, the contact spacing 176 may be approximately 2.159 millimeters, or 0.0850 inches. A different contact spacing 176 may be used in other embodiments. For example, the contact spacing 176 may slightly differ from the contact spacing 158 of the plug contacts 108.

The receptacle connector 104 has an exterior width 168 along the longitudinal axis 154 and a height 170 along the transverse axis 156. For example, opposing exterior sides 180, 182 of the receptacle housing 114 are separated by the exterior width 168. In some embodiments, the exterior width 168 spans across the flanges 115 (shown in FIG. 1). In one or more other embodiments, the exterior width 168 does not include the flanges 115. For example, the exterior width 168 may span between the opposing sides 186, 188 of the receptacle housing 114.

In some embodiments, the exterior width 168 is less than the exterior width of known receptacles for RJ-21 or RJ-45 connectors having the same number of contacts as the receptacle connector 104. The exterior width 168 may be less than the width of known receptacles for RJ-21 or RJ-45 connectors while still including 48 receptacle contacts 134. As described above, the width 164 of the plug connector 102 may be less than the width of known RJ-21 or RJ-45 connectors. By reducing the width 164 of the plug connector 102, the receptacle connector 104 also may have a reduced exterior width 168 when compared to known RJ-21 and RJ-45 receptacles.

The nose 136 has a width 178 along the longitudinal axis 154. In some embodiments, the width 178 is the greatest width of the nose 136 along the longitudinal axis 154. The width 178 is less than the greatest width of the noses for receptacles of known RJ-21 or RJ-45 connectors having the same or greater number of contacts as the receptacle contacts 134 in the receptacle connector 104 in some embodiments. For example, the width 178 may be approximately 33 millimeters or less.

The plug connector 102 may have a different number of plug contacts 108 on each chicklet 122. For example, each of the chicklets 122 may include more than eight plug contacts 108. In one embodiment, each chicklet 122 may hold twelve plug contacts 108, with six plug contacts 108 on each contact side 141, 143. Increasing the number of plug contacts 108 on each chicklet 122 may increase the density of plug contacts 108 in the plug connector 102.

The plug connector 102 may have a different number of chicklets 122. By way of example only, the plug connector 102 may have four, six, nine, twelve, or eighteen chicklets 122. Increasing the number of chicklets 122 may Increase the density of plug contacts 108 in the plug connector 102.

By changing the number of chicklets 122 and/or the number of plug contacts 108 on each chicklet 122 In the plug connector 102, various numbers of plug contacts 108 may be provided in the plug connector 102. By way of example only, the plug connector 102 may include four chicklets 122 with twelve plug contacts 108 on each chicklet 122 for a total of 48 plug contacts 108. In another example, the plug connector 102 may include nine chicklets 122 with eight plug contacts 108 on each chicklet 122 for a total of 72 plug contacts 108. In another example, the plug connector 102 may include six chicklets 122 with twelve plug contacts 108 for a total of 72 plug contacts 108. In another example, the plug connector 102 may include eighteen, chicklets 122 with eight plug contacts 108 on each chicklet 122 for a total of 144 plug contacts 108. In another example, the plug connector 102 may include twelve chicklets 122 with twelve plug contacts 108 on each chicklet 122 for a total of 144 plug contacts 108.

The number of plug contacts 108 in the plug connector 102 may be increased without increasing the exterior width 164 beyond the exterior width of known plug electrical connectors, including known CHAMP® style plug connectors. For example, the plug connector 102 may include 48 ping contacts 108 while having the exterior width 164 be approximately 45 millimeters or less. In another example, the plug connector 102 may include 72 plug contacts 108 while having the exterior width 164 be approximately 44 millimeters or less. In another example, the plug connector 102 may include 144 plug contacts 108 while having the exterior width 164 be approximately 84 millimeters or less.

The receptacle connector 104 may have a different number of receptacle contacts 134 on each wall surface 148 of the receptacle walls 130 and the outer walls 135. For example, each of the wall surfaces 148 may include more than eight receptacle contacts 134. In one embodiment, each wall surface 148 may hold twelve receptacle contacts 134, with six receptacle contacts 134 on each side 165, 167 of the wail surface 148. Increasing the number of receptacle contacts 134 on each wall surface 148 may increase the density of receptacle contacts 134 in the receptacle connector 104.

The receptacle connector 104 may have a different number of slots 132. By way of example only, the receptacle connector 104 may have four, six, nine, twelve, or eighteen slots 132. Increasing the number of slots 132 may increase the density of receptacle contacts 134 in the receptacle connector 104.

By changing the number of slots 132 and/or receptacle contacts 134 in the receptacle connector 104, various numbers of receptacle contacts 134 may be provided in the receptacle connector 104. By way of example only, the receptacle connector 104 may include four slots 132 with twelve receptacle contacts 134 on each wail surface 148 for a total of 48 receptacle contacts 134. In another example, the receptacle connector 104 may include nine slots 132 with eight receptacle contacts 134 on each wall surface 148 for a total of 72 receptacle contacts 134. In another example, the receptacle connector 104 may include six slots 132 with twelve receptacle contacts 134 on each wall surface 148 for a total of 72 receptacle contacts 134. In another example, the receptacle connector 104 may Include eighteen slots 132 with eight receptacle contacts 134 on each wall surface 148 for a total of 144 receptacle contacts 134. In another example, the receptacle connector 104 may include twelve slots 132 with twelve receptacle contacts 134 on each wall surface 148 for a total of 144 receptacle contacts 134.

The number of receptacle contacts 134 in the receptacle connector 104 may be increased without increasing the exterior width 168 and/or the width 178 of the nose 136 beyond the exterior width of known electrical receptacles, including receptacles for known CHAMP® style connectors. For example, the receptacle connector 104 may include 48 receptacle contacts 134 while having the exterior width 168 be approximately 45 millimeters or less and/or the width 178 of the nose 136 be approximately 33 millimeters or less. In another example, the receptacle connector 104 may include 72 receptacle contacts 134 while having the exterior width 168 be approximately 42 millimeters or less and/or the width 178 of the nose 136 be approximately 33 millimeters or less. In another example the receptacle connector 104 may include 144 receptacle contacts 134 while having the exterior width 168 be approximately 84 millimeters or less and/or the width 178 of the nose 136 be approximately 80 millimeters or less.

Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. For example, while certain numbers of chicklets 122, receptacle chicklets 131, plug contacts 108 and receptacle contacts 134 are included in each of the illustrated embodiments, the number of chicklets 122, receptacle chicklets 131, plug contacts 108 and/or receptacle contacts 134 may be varied from the illustrated amounts. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted, based on 35 U.S.C. §112, sixth paragraph, unless and until such claim limitations expressly use the phrase "means for" followed by a statement of function void of further structure.

What is claimed is:

1. An electrical connector assembly comprising:

a plug connector having plug contacts and a shroud partially surrounding the plug contacts, the shroud having a shape that is elongated along a longitudinal axis, the shroud framing the plug contacts;

a receptacle connector having a nose with a shape that is elongated along the longitudinal axis, the nose comprising a plurality of slots formed therein and oriented along a transverse axis relative to the longitudinal axis, the plug contacts being separated from the shroud such that when the plug and receptacle connectors are co-nested with one another, the nose is received in the shroud and the plug contacts are received in a corresponding one of the slots in order to mate the plug and receptacle connectors; and a plurality of contact walls in the plug connector, each of the contact walls holding a subset of the plug contacts, the contact walls being elongated along the transverse axis.

2. The connector assembly according to claim 1, wherein the plug contacts are arranged in a plurality of groups of plug contacts, each of the groups of the plug contacts aligned along the transverse axis.

3. The connector assembly according to claim 1, wherein the receptacle connector comprises a plurality of receptacle contacts arranged in a plurality of groups, each of the groups of the receptacle contacts aligned along the transverse axis.

4. An electrical receptacle connector configured to mate with an electrical plug connector to provide an electrical connection between the plug and receptacle connectors, the plug connector having a shroud having a shape that is elongated along a longitudinal axis and having a plurality of contact walls elongated along a transverse axis, the transverse axis being transverse to the longitudinal axis, each of the contact walls holding a group of plug contacts aligned along the transverse axis, the receptacle connector comprising:

a housing having a nose that is configured to be inserted into the shroud of the plug connector, the nose having a shape that is elongated along the longitudinal axis;

a plurality of chicklets held by the housing, each chicklet having a receptacle wall protruding from a header portion, the receptacle walls being located proximate to the nose and oriented along the transverse axis; and a plurality of receptacle contacts arranged in groups, each of the groups being held by a corresponding one of the chicklets, the receptacle contacts in each of the groups being arranged in parallel rows along the receptacle wall, wherein the nose is inserted into the shroud and each of the contact walls is inserted between adjacent ones of the receptacle walls when the plug and receptacle connectors mate with one another so that the plug and receptacle contacts engage one another.

5. The connector assembly according to claim 1, further comprising a plurality of receptacle walls in the receptacle connector, each of the slots being disposed between adjacent ones of the receptacle walls, each of the receptacle walls holding a plurality of receptacle contacts configured to engage a subset of the plug contacts when the plug and receptacle connectors co-nest with one another.

6. The connector assembly according to claim 1, wherein the shroud and the nose have complementary shapes.

7. The connector assembly according to claim 1, wherein the receptacle connector comprises a lip extending around a periphery of the nose, the lip protruding along a mating direction and received between the contact walls and the shroud when the plug and receptacle connectors co-nest with one another.

8. An electrical plug connector configured to mate with an electrical receptacle connector to provide an electrical connection between the plug and receptacle connectors, the receptacle connector having a nose with a shape that is elongated along a longitudinal axis and having a plurality of slots in the nose with a plurality of receptacle contacts disposed along opposing sides of each of the slots, the plug connector comprising:

a housing having a shroud that is configured to receive the nose of the receptacle connector, the shroud having a shape that is elongated along the longitudinal axis;

a plurality of chicklets held by the housing, each chicklet having a contact portion protruding from a header portion, the contact portion being located proximate to the shroud and being oriented along a transverse axis, the transverse axis being transverse to the longitudinal axis; and a plurality of plug contacts arranged in groups, each of the groups being held by a corresponding one of the chicklets, the plug contacts in each of the groups being arranged in parallel rows along the contact portion, wherein the shroud receives the nose and each of the slots receives one of the contact portions when the plug and receptacle connectors mate with one another so that the plug and receptacle contacts engage one another.

9. The plug connector according to claim 8, wherein each of the contact portions are separated from the shroud along the transverse axis by a clearance distance, the clearance distance being approximately the same as or greater than a thickness of an outer lip of the nose.

10. The plug connector according to claim 8, wherein each of the plug contacts extends along a corresponding one of the contact portions along a mating direction on an outside surface of the contact portion.

11. The plug connector according to claim 8, wherein each of the plug contacts extends along a corresponding one of the header portions along a mating direction on the inside of the header portion.

12. The plug connector according to claim 8, wherein the contact portions of adjacent ones of the chicklets are separated by approximately 5 millimeters or more.

13. The plug connector according to claim 8, wherein the header portions of adjacent ones of the chicklets abut one another.

14. The plug connector according to claim 8, wherein the rows are aligned along the transverse axis.

15. The receptacle connector according to claim 4, wherein each of the receptacle contacts extends between front and base ends of each of the chicklets, the front end being proximate to the nose, the base end being configured to be mounted on a circuit board, the front and base ends being perpendicular to one another.

16. The receptacle connector according to claim 4, wherein adjacent ones of the receptacle walls define a slot, each of the slots having a plurality of the receptacle contacts on opposing sides of each slot, the receptacle contacts in each slot arranged so as to engage one of the groups of the plug contacts.

17. The receptacle connector according to claim 4, wherein the housing includes a lip that extends around a periphery of the nose, the lip having a thickness that is no greater than a clearance distance along the transverse axis between the contact walls and the shroud.

18. The receptacle connector according to claim 4, wherein, each of the receptacle contacts extends along a corresponding one of the receptacle walls along a mating direction on an outside surface of the receptacle wall.

19. The receptacle connector according to claim 4, wherein each of the receptacle contacts extends along a corresponding one of the header portions along a mating direction on the inside of the header portion.

* * * * *